United States Patent [19]

Rise

[11] Patent Number: 4,811,469

[45] Date of Patent: Mar. 14, 1989

[54] QUICK RELEASE FASTENERS

[76] Inventor: Leif Rise, 7748 Westlawn Ave., Los Angeles, Calif. 90045

[21] Appl. No.: 77,428

[22] Filed: Jul. 24, 1987

[51] Int. Cl.[4] ..... A41F 1/00

[52] U.S. Cl. ..... 24/664; 24/662

[58] Field of Search ..... 24/664, 309, 323, 169, 24/198, 200, 653, 656, 679, 681, 662, 663, 657

[56] References Cited

U.S. PATENT DOCUMENTS

| | | | |
|---|---|---|---|
| 278,346 | 5/1883 | Long | 24/662 X |
| 1,014,148 | 1/1912 | Heller | 24/662 X |
| 1,228,256 | 5/1917 | Stoll | 24/663 |
| 2,040,958 | 5/1936 | Schuttenfels | 24/198 |
| 2,084,412 | 6/1937 | Schaefer | 24/198 X |
| 2,943,737 | 7/1960 | Rapata . | |
| 3,401,986 | 9/1968 | Nicholas | 24/662 X |
| 3,495,305 | 2/1970 | Mezerenyi et al. | 24/200 X |
| 4,150,464 | 4/1979 | Tracy . | |
| 4,282,634 | 8/1981 | Krauss | 24/323 |
| 4,566,616 | 1/1986 | Rise . | |

*Primary Examiner*—Kenneth J. Dorner
*Assistant Examiner*—Laurie K. Cranmer
*Attorney, Agent, or Firm*—Edward D. O'Brian

[57] ABSTRACT

A simple, two piece, plastic fastener structure can be formed to include a latch receptacle having an open end leading to an internal cavity defined by front and back sides and top and bottom walls. The front and back sides are shaped so as to include openings located opposite one another. The fastener structure also includes a catch member having a body portion shaped more or less like a tongue which is capable of being inserted within the opening. When it is so inserted sloping walls on catches on the tongue will spread the front and back sides apart until such time as the catches are adjacent to the openings. At this point the sides will spring back to their original configuration so as to secure the catches in the openings so as to hold the catch member relative to the receptacle. The catch member may be released by pushing on the top and bottom walls of the receptacle so as to bow the sides outwardly until the catch member can be withdrawn from the cavity.

5 Claims, 1 Drawing Sheet

QUICK RELEASE FASTENERS

BACKGROUND OF THE INVENTION

This invention pertains to new and improved quick release fasteners and to a new and improved manner of securing parts of them to the ends of belts. On occasion these fasteners are referred to as buckles.

The fact that both the terms "fastener" and "buckle" can be used in describing a structure in accordance with this invention indicates that there is a degree of confusion and inconsistence in the manner in which these two terms are used. Various other terms such as "clasp" can also be used to designate structures falling within the scope of this disclosure. This ambiguity in connection with the meaning of mechanical terms is characteristic of much mechanical terminology. Presumably this is a result of the gradual expansion and change of technology over a prolonged time period.

Seldom is such a time period as long as it is in connection with the field of the present invention. In all probability the initial fasteners or clasps used predate recognized civilization when they were used in order to hold skins, straps or whatever in a desired relationship. In spite of the incredibly long duration of the field of the invention it is believed that a need still exists for new and improved fasteners or buckles of the type to which this invention pertains. More specificially it is considered that there exists a need for fasteners of a type as herein described which can be inexpensively manufactured, which can be easily used to attach to ends such as the ends of a belt and which may be easily and conveniently released as desired.

BRIEF SUMMARY OF THE INVENTION

It is believed that it will be apparent from the preceding that this invention is intended to provide new and improved fasteners or buckles which are more desirable than prior related fasteners or buckles. The invention is intended to provide fasteners as herein described which can be easily and conveniently manufactured out of a relatively inert, corrosive resistant material at a comparatively nominal cost using known injection molding techniques. It is also intended to provide fasteners which can be easily assembled so as to secure such things as the two ends of a belt to one another and which, when used, reasonably secure such things together in such a manner that there is only minimal danger of them becoming disengaged but in such a manner that they may be easily and quickly released from one another when this is desired.

Because of the nature of the invention it is believed that it is unnecessary to indicate various other more detailed objectives of the invention. Other objectives and/or advantages of the invention will be apparent from a detailed consideration of the remainder of the specification and the appended claims. All of such objectives of the invention are achieved by providing a fastener structure having a latch receptacle and a catch member which is adapted to be inserted into the latch receptacle so as to distend at least one latch member within the receptacle until such time as the resilience of the material in the latch receptable causes the latch member to engage a catch surface on the catch member so as to secure the catch member against movement away from the latch receptacle until the user of the fastener structure deliberately deforms the latch receptacle until the catch surface is released so that the catch member can be withdrawn from the latch receptacle.

BRIEF DESCRIPTION OF THE DRAWING

A fastener structure of the invention is preferably constructed so as to include details not indicated or suggested in the preceding summary. It is considered that the invention and such details are best more fully described or explained with reference to the accompanying drawing in which.

Figure 1:
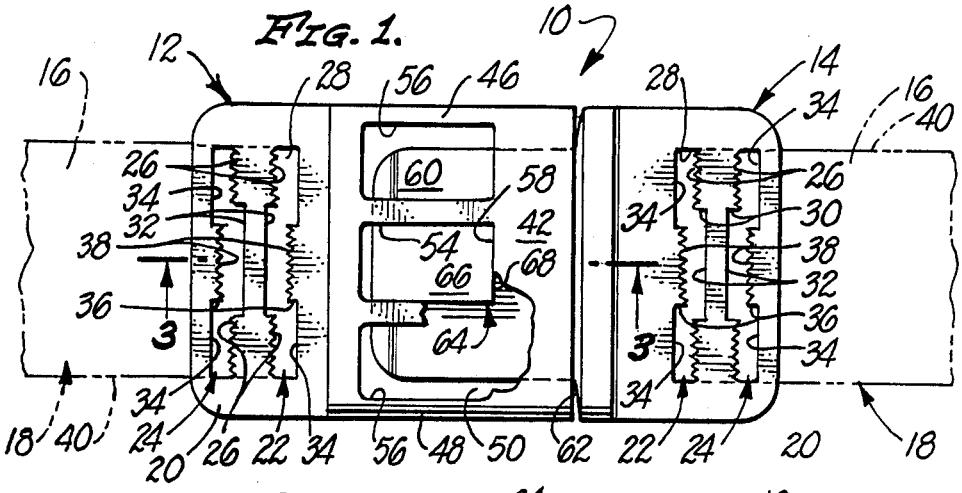
FIG. 1 is a front elevational view of a presently preferred embodiment of a quick release fastener in accordance with the invention in which the ends of a belt secured by the fastener are shown in phantom, the latch receptacle in this view being partially broken away to show a catch means employed.
Figure 2:
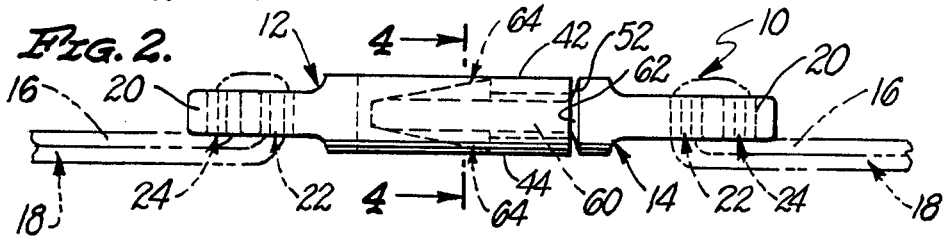
FIG. 2 is a bottom plan view of the fasteners illustrated in FIG. 1.
Figure 3:
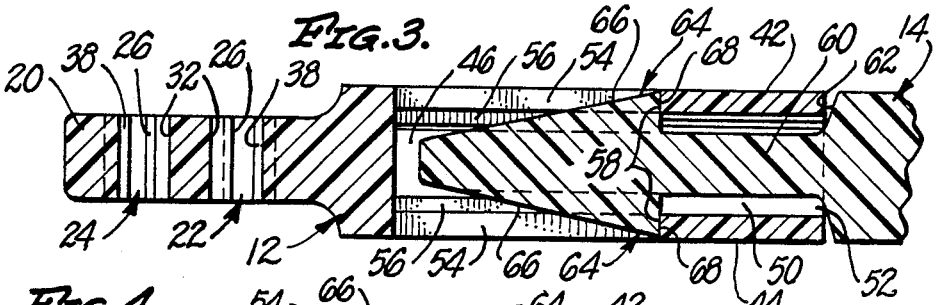
FIG. 3 is a partial cross-sectional view at an enlarged scale taken at line 3—3 of FIG. 1.

The particular fastener structure illustrated in the drawing is constructed so as to utilize the operative concepts or principles of the invention which are set forth or defined in the appended claims forming a part of this disclosure. Those skilled in the design and construction of buckles and related fasteners will realize that it is easily possible to incorporated these principals with a wide variety of differently appearing and differently constructed fasteners or buckles through the use of routine skill in the filed of the design and construction of such buckles and related fasteners. For this reason the accompanying drawing is not to be considered as limiting the scope of this invention.

DETAILED DESCRIPTION OF THE PREFERRED EMBODIMENT

In the drawing there is shown a fastener structure 10 in accordance with this invention which includes two principal, separatable parts: a latch receptacle 12 and a catch member 14. Each of these is preferably formed as a one piece integral unit out of a self-supporting, corrosion resistant, slightly deformable or resilient polymer material. Since many suitable such materials are know it is not considered necessary to set forth a list of such materials in this specification. By forming the receptacle 12 and the catch member 14 in this manner out of such a material it is possible to provide an inexpensive fastener structure 10 which is corrosion resistant and which may be satisfactorily used for a prolonged period.

Because of the fact that the particular fastener structure 10 illustrated is intended to be used in holding the ends 16 of a webbed of similar known belt 18 the receptable 12 is provided with a belt holding end 20 and the catch member 14 is provided with a corresponding end 20. These two ends 20 are constructed so as to extend generally transverse to the width (not separately numbered) of the belt 18. Each of them includes two elongated slots 22 and 24. These slots 22 and 24 are generally parallel; they are dimensioned so as to be slightly longer and wider than the width of the belt 18 or any other belt which is expected to be used with the complete structure 10.

The slots 22 and 24 have sides 26 which are adjacent to one another and sides 28 which are located remote from one another as shown. The sides 26 are provided with serrated edges (not separately identified) and contain centrally located notches 30 having flat bottoms 32. As opposed to this the sides 28 have flat bottoms 34 from which there extend projections 36 having tops 38 which can be referred to as serrated, flat tops since they are flat except for the fact that they are serrated. The projections 36 are not as long as the notches 30.

This construction of the slots 22 and 24 permits each end 16 of the belt 18 to be connected to the fastener structure by first being inserted through a slot 22 in an end 20 and then being inserted through a slot 24 in the same end 20 and then pulled so as to extend generally away from this end 20. During such insertion the side edges 40 of the belt 18 will normally have to be pushed towards one another slightly so as to slightly bow the belt 18 across its width in order to facilitate the belt 18 fitting within these slots 22 and 24. When the belt 18 is pulled after being so inserted it will be deformed so as to be frictionally held by contact with the interiors of the slots 22 and 24 and by contact with itself along the end 20 in such a manner that there is substantially no danger of it coming loose.

Figure 4:
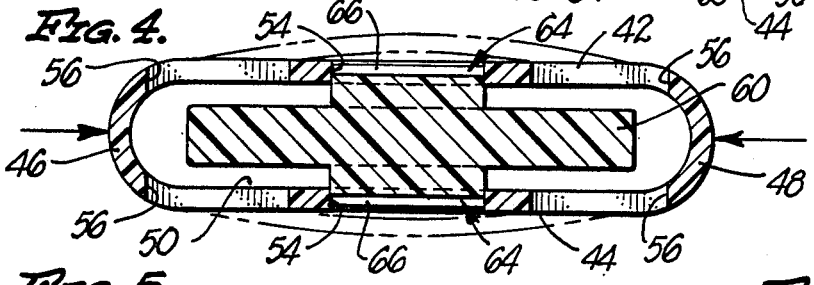
FIG. 4 is a cross-sectional view at an enlarged scale taken at line 4—4 of FIG. 2.
Figure 5:
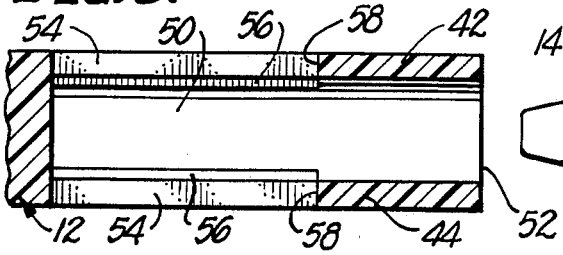
FIG. 5 is a partial cross sectional view corresponding to part of FIG. 3 showing a part of the latch receptacle used with the fastener.
Figure 6:
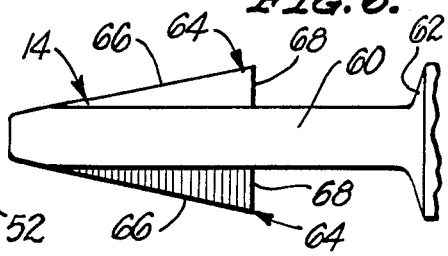
FIG. 6 is a partial bottom elevational view of the "operative" part of the catch member which engages latch surfaces apparent in FIG. 5.

The receptable 12 is formed so as to include a front side 42 which overlays and is spaced from a back side 44, a top wall 46 and a bottom wall 48. As shown in Fig. 4 the walls 46 and 48 are semi-cylindrical in shape. The sides 42 and 44 are connected by the walls 46 and 48 so as to define a generally flat, generally rectangular internal cavity 50 having an open end 52 located remote from the end 20 of the receptacle 12. The latter end 20 is connected to the sides 42 and 44 and the walls 46 and 48 so as to extend generally from them and the cavity 50 as shown.

Rectangular openings 54 of the same size are provided in both of the sides 42 and 44 opposite one another in a location midway between the walls 46 and 48 and adjacent to the end 20 of the receptacle 12. Preferably corresponding openings 56 are provided between the openings 54 and the walls 46 and 48 for the purposes of saving weight and increasing the flexibility of these walls 46 and 48. The openings 54 have identical linear edges 58 which extend perpendicular to the walls 46 and 48 and parallel to the end 52. Because of their function as subsequently explained these edges 58 may be referred as to as "latch means".

The catch member 14 is formed so as to have a body portion or tongue 60 of an essentially flat, rectangular tongue-like shape which is dimensioned to fit loosely within the cavity 50. The extent to which the catch member can be inserted within the cavity 50 is limited by a small shoulder 62 separting the body portion 60 from the end 20 of the catch member 14. This catch member 14 also includes what may be referred to as catch means 64. There are two of the latter and they are located on the tongue 60. In the illustrated structure two of these catch means 64 are used. One is located so as to be adjacent to the front side 42 and the other is located so as to be adjacent to the back side 44 when the structure 10 is assembled.

Each of these catch means 64 includes a sloping, wedge-like wall 66 which is pointed generally away from the end 20 of the catch means 14 and a shoulder or catch surface 68 located perpendicular to the tongue 60. These catch means 64 are slightly smaller than the openings 54 so as to be capable of extending into them. Preferably they should not extend significantly through the openings 54 past the front and backs sides 42 and 44 since if they were to extend to such an extent the fastener structure 10 might be difficult or impossible to operate.

The use of the fastener structure 10 is considered to be a relatively simple matter. Prior to it being used the latch receptacle 12 and the catch member 14 will normally be attached to a belt 18 or other similar member in the manner previously described when the receptacle 12 and the catch member 14 are separate and apart from one another.

Then the latter two members are assembled by inserting the tongue 60 of the catch member 14 through the end 52 into the cavity 50. As this occurs the walls 66 will engage the front and back sides 42 and 44 so as to distend or bow them outwardly as indicated by the phantom lines in FIG. 4 to a sufficient extent so that the catch means 64 may be moved within cavity 50 until such time as the catch means are located in the general vicinity of the openings 54. It is obvious that as the sides 42 and 44 are moved in this manner that the walls 46 and 48 will be drawn toward one another. When the catch members 64 are opposite these openings 54 the inherent resiliency of the fastener structure 10 will cause the sides 42 and 44 to more or less snap back to their original configuration so as to place the catch sufaces or shoulders 68 adjacent to the edges 58.

At this point the fastener structure 10 is fully assembled and the catch member 14 cannot be withdrawn from the receptacle 12. In order to withdraw the catch member 14 it is necessary to concurrently push on both the top wall 46 and the bottom wall 48 as indicated by the arrows in FIG. 4 so as to bow the front and back sides 42 and 44 outwardly to such an extent that the catch surfaces or shoulders 68 are released. At this point the catch member 14 can be withdrawn from the receptacle 12.

It will be recognized from the preceding that in order for the fastener 10 to operate as described that it is necessary for the thickness of both of the catch means 64 and the tongue 60 to vary from being smaller than the distance between the front and rear sides 42 and 44 to being greater than this distance immediately adjacent to the catch surfaces or shoulders 68. This maximum thickness must not exceed the amount that the sides 42 and 44 can be bowed outwardly away from one another when the body portion or tongue 60 is inserted within the cavity 52. If the maximum thickness exceeds this value the structure 10 cannot be operated as described.

On occasions it may be desirable to use the fastener structure 10 with other structures than are illustrated for attaching the receptacle 12 and the catch member 14 to a belt or other member or members to be secured using this fastener structure 10. In theory it is possible to dispense with one of the catch means 64 employed in the fastener structure 10. It is preferred to use both of the catch means 64 as described in order to achieve an effective holding action.

I claim:

1. A fastener structure including a unitary latch receptacle of a deformable, resilient material which is provided with an open end and an internal latch means accessible through said open end and including a catch member shaped so as to be capable of being inserted into said latch receptacle through said open end, said catch member being provided with a catch means capable of being engaged by said latch means so as to secure said catch member against movement relative to said latch receptacle when said catch member has been inserted into said receptacle in which the improvement comprises:

said latch receptacle has a base which is adapted to be used in attaching said receptacle to a belt, said open end being located on an end of said latch receptacle which is opposite said base, said receptacle also having a front side, a back side, a top wall and a bottom wall, said front and back sides being opposite one another and extending between said ends of said latch receptacle, said top and bottom walls being opposite one another and extending between said ends of said latch receptacle, said top and bottom walls having unitary walls connecting said front and back sides, said front and back sides and said top and bottom walls defining an internal cavity within said receptacle, which cavity is in communication with said open end, one of said sides including latch means, said latch means extending from said one of said sides into the interior of said cavity a sufficient distance so that when said catch member is inserted into said cavity through said open end, said catch means distends said latch receptacle so as to bow said front and back sides outwardly away from one another as said top and bottom walls are moved toward one another as said catch means is inserted through said open end until such time as said latch means is adjacent to said catch means in a position in which the resilience of said receptacle will cause said catch means to move into engagement with said catch means so as to hold said catch means in engagement with said latch means by contact between said catch means, said receptacle being sufficiently large and resilient and said catch member being sufficiently small to permit the disengagement of said latch means from said catch means so as to release said catch member upon pressure being applied to said top and bottom walls so as to move them towards one another so as to cause said sides to bow outwardly away from one another, said catch means being incapable of acting on said front and back sides so as to be released from said cavity by being pulled from it after being inserted unless pressure is applied to said walls of said receptacle to cause them to move so that said sides are bowed to release said catch means, said catch means and said latch means having vertical shoulders which cooperate to hold said catch member in said cavity except when pressure is applied to said sides of said receptacle, said top and bottom walls being sufficiently curved so as to facilitate said sides bowing when pressure is applied to said top and bottom walls.

2. A fastener structure as claimed in claim 1 wherein:

each of said sides includes a latch means, there are two of said catch means, each of said catch means being located so as to be capable of being engaged and held by one of said latch means, and said latch means on said sides are identical.

3. A fastener structure as claimed in claim 1 wherein:

each of said latch means comprises an edge of an opening in one of said sides.

4. A fastener structure as claimed in claim 1 wherein:

each of said sides includes a latch means, there are two of said catch means, each of said catch means having a surface located so as to be capable of being engaged and held by one of said latch means, and said latch means on said sides are identical, each of said latch means comprises an edge of an opening is one of said sides, said edges of said latch means being capable of engaging said surfaces of said catch means so as to be held thereby.

5. A fastener structure as claimed in claim 1 wherein:

each of said sides includes a latch means, there are two of said catch means, each of said catch means being located so as to be capable of being engaged and held by one of said latch means, said latch means on said sides are identical, and both of said catch means are identical, each of said catch means comprises a sloping, wedge-like wall leading to a catch surface capable of engaging said latch means so as to secure said catch member against motion away from said latch receptacle, said latch receptacle is provided with a rectangular internal cavity accessible from said open end and said front and back sides are the sides of said receptable and are the sides of said cavity.

* * * * *